United States Patent [19]

Sarstedt

[11] 4,133,211

[45] Jan. 9, 1979

[54] SUCTION PIPETTE

[76] Inventor: Walter Sarstedt, 5223 Nümbrecht, Rommelsdorf, Fed. Rep. of Germany

[21] Appl. No.: 848,396

[22] Filed: Nov. 4, 1977

[30] Foreign Application Priority Data

Nov. 10, 1976 [DE] Fed. Rep. of Germany ..... 2651333

[51] Int. Cl.[2] ..... B01L 3/02

[52] U.S. Cl. ..... 73/425.6

[58] Field of Search ..... 73/425.4 P, 425.6

[56] References Cited

U.S. PATENT DOCUMENTS

| | | | |
|---|---|---|---|
| 3,646,817 | 3/1972 | Hinchman | 73/425.6 |
| 3,933,048 | 1/1976 | Scordato | 73/425.6 |
| 4,036,064 | 7/1977 | Hydo | 73/425.6 |

*Primary Examiner*—S. Clement Swisher

*Attorney, Agent, or Firm*—McGlynn and Milton

[57] ABSTRACT

This invention relates to a suction pipette comprising, a first piston located within a cylinder and connected to a first hollow, cylindrical piston rod and a second piston located within the first hollow, cylindrical piston rod and connected to a second piston rod such that small doses of fluid may be delivered accurately from the fluid contained within the pipette.

7 Claims, 3 Drawing Figures

SUCTION PIPETTE

The present invention relates to a suction pipette.

One type of known suction pipette comprises a cylinder with a conical projection for the purposes of mounting interchangeable pipette heads, a piston which is displaceable in an air-tight manner within the cylinder between two limiting positions, a piston rod connected thereto which projects out of the cylinder in every position of the piston, is guided within the cylinder and has at its free end a control knob, and a compression spring disposed in the cylinder between the piston and the cylinder projection and supported on one side on a shoulder of the cylinder and on the other on the piston.

In the operation of this known type of suction pipette a downwards pressure of the piston first partly pushes the air out of the cylinder below the piston through the mounted pipette head, the pipette head is then dipped into the fluid which is to be sucked up, and the piston is then released. The compression spring now pushes the piston again into its upper end position, thereby creating a reduced pressure below the piston which causes the fluid to be sucked into the pipette head. The travel which is determined by the two end positions of the piston is such that the pipette head is filled until just below the conical projection.

In using suction pipettes of this type in chemical laboratories, particularly, however, is medico-technical research establishments, hospitals and the like, it is frequently desirable to deliver the quantity of fluid, e.g. blood serum, taken up by means of such a suction pipette, subsequently in small doses, in order to be able to carry out series of experiments on the fluid.

In order to make removal of fluid by doses possible, it has already been proposed to provide the piston rod with a scale or to mount several notches and a click-stop device between the piston rod and the cylinder in such a manner that, in moving the piston rod from one graduation to the next or from one notch to the next, the desired quantity of fluid is delivered.

As the travel of the piston and the cylinder diameter in this kind of suction pipette, however, are such that a larger quantity of fluid must first be sucked in, the subsequent delivery of smaller quantities of fluid is, of necessity, not possible with a sufficient degree of accuracy, even when the greatest care is exercised by the technical personnel.

The object of the invention is to develop the known suction pipette in such a manner that an accurate delivery of smaller predetermined quantities of fluid from the overall quantity, initially sucked up, is easily possible and with a high degree of accuracy.

According to the present invention there is provided a suction pipette which comprises a cylinder having a conical projection at one end for the purpose of mounting interchangeable pipette heads, a first piston located within the cylinder and displaceable in an air-tight manner between two limiting positions, a first hollow cylindrical piston rod connected, at one end, to the first piston, said first piston rod projecting out of the cylinder in all positions of the first piston and being guided within the cylinder, a first compression spring disposed within the cylinder between the first piston and the conical projection and supported at one end on a shoulder of the cylinder and at the other end on the first piston, a second piston accommodated within the first piston rod in an air-tight and displaceable manner, a second piston rod, one end of which is connected to the second piston, a second compression spring biasing the second piston away from the first piston and whereby the travel of the second piston is limited by stops in such a manner that a predetermined stroke volume is achieved which is small in relation to the stroke volume of the first piston in the cylinder.

As the diameter of the inner piston and the internal diameter of the cylindrical piston rod of the outer piston are necessarily smaller than the external diameter of the outer piston, during a definite travel of the inner piston a smaller volume is displaced than would be the case with an equal travel of the outer piston. The smaller the diameter of the inner piston chosen, the smaller will be the stroke volume of the inner piston at a given travel. This means that a small quantity of fluid can be displaced by means of a relatively large travel of the inner piston, so that the accuracy of delivery can accordingly be increased.

The method of operation of the suction pipette, in accordance with the present invention, is as follows:

Initially both pistons are located in their first or upper positions in which the two compression springs are in their least compressed form. Then the control knob at the end of the second or inner piston rod is pushed downwards. The second or inner piston thereby first moves into its second limiting or lower position in which the second compression spring is in its most compressed form. Then the control knob is pushed further downwards so that the first cylindrical piston rod is taken along with the first or outer piston and guided downwards in the outer cylinder. As soon as the outer cylinder has reached its second limiting or lower position wherein the first compression spring is in its most compressed form, the suction pipette, mounted on the conical projection at the lower end of the cylinder, is dipped with its lower opening into the fluid to be taken up and the control knob released. Both pistons are pushed back into the first positions by their compression springs, whereby the pipette head mounted is filled with fluid.

To deliver small dosed quantities the control head is now pressed downwards in each case so far, until the inner piston reaches its lower limiting position. By appropriate proportioning of the springs this lower end position can be easily felt. After the small quantity of fluid has been delivered, the control knob is again released so that the compression springs, located in the cylindrical piston rod, again press the inner piston into its upper end position. A corresponding reduced pressure is thus created in the chamber below the inner piston and thereby also at the same time below the first piston and is equalised in that the quantity of air corresponding to the small quantity of fluid delivered penetrates the lower opening of the pipette head and bubbles upwards through the fluid. By renewed pressure on the control knob a second equal quantity of fluid can be delivered and so on.

Quite good results have been achieved by means of such a suction pipette. A further increase in accuracy is possible in the development of the present invention by preventing the air from bubbling back after the delivery of a small quantity of fluid and in its place ensuring by means of a corresponding valve gear that this quantity of air is replaced from above. Dependent on the construction of the lower slender tip of a pipette head occasional differences and thus measured errors are, in fact, evident in actual operation due to the fact that a part of the air which flows in from below does not bubble upwards but remains suspended at the lower end of the pipette head due to capillary action and the viscosity of the liquid.

A remedy is here provided by a valve means, controlled by the second inner piston rod, which when the second piston is in a first limiting position with the second compression spring in its least compressed form connects the chamber formed by the first or outer cylindrically shaped piston rod and the second piston displaceable therein, with the outer air, the valve means being closed when the second piston is moved just away from the first limiting position and a second valve means which, when the second piston is in a second limiting position with the second compression spring in its most compressed form, connects the chamber formed by the first, hollow cylindrical piston rod and the second piston with the chamber formed by the cylinder and the first piston, the second valve means being closed when the second piston moves a small distance away from the second limiting position towards the first limiting position.

Both these controlled valves act exclusively on the second or inner piston and in the manner hereinbelow described in greater detail have the effect that, when the inner piston is pressed downwards, the small metered fluid quantity is delivered and no vacuum is produced in the mounted pipette head above the fluid when the piston is restored due to the effect of the compression springs, the air, however, flowing into the chamber below the inner piston from outside. As soon as the inner piston is moved somewhat downwards out of its upper end position the first valve is closed. Further downwards movement creates an excess pressure below the inner piston and this piston is displaced by a stroke volume which is equal to the volume of fluid that is to be delivered. As soon as the inner piston has almost reached its lower end position the second valve is opened. The excess pressure is equalised and the air displaces the predetermined quantity of fluid out of the pipette head.

As soon as the control knob is released and the inner piston has begun its upwards movement under the effect of the compression springs, the second valve is closed, just above the lower end position, so that the vacuum which is created during the upwards movement of the piston, is not capable of sucking fluid or air out of the pipette head. The vacuum which is being created during the further upwards movement of the inner piston below and piston is finally eliminated again, when the inner piston has almost reached its upper end position, due to the first valve being opened and atmospheric air flowing in.

By means of appropriate dimensions of the valves it is possible to ensure without further measures that the reversing takes place in each case just above the lower end position or just below the upper end position of the inner piston and thus no dosage errors result. The valves may be constructed in various ways. It has been preferably suggested that the first valve be formed by an extension of the cylindrical piston rod, accommodating the inner piston, at and just below the upper end position of the piston. As soon as the piston moves into this widened area the air between the piston and the extended cylinder wall can flow through unhindered.

Another advantageous embodiment of the first valve is comprised in that a bore is disposed in the wall of the first hollow cylindrically shaped piston rod just below the second or inner piston, located in the upper end position. As soon as the inner piston passes this bore in its upwards movement, air can flow into the chamber below the inner piston from outside.

It is preferably proposed that the second valve is a spring-loaded non-return valve, which is opened of necessity by a lower projection on the piston, when the latter during its downwards movement is located just before its lower end position. The valve is thus closed by its inherent spring if it is not opened of necessity by the lower projection on the piston. The converse is ensured in that during the upwards movement of the piston out of its lower end position the compulsory opening of the valve is exposed shortly afterwards and the valve is closed by its inherent spring.

It is thereby preferably provided that the spring closing the second valve is made only so strong that during the downwards movement of the piston the valve is already opened by the excess pressure produced by the second piston. This has the result that fluid is already being delivered from the pipette head during a part of the downwards travel of the second or inner piston and this is not delayed until the last moment in that the projection on the piston of necessity opens the valve. If the spring is in fact made so strong that the valve is not opened until this is done by the projection on the piston, the sudden relaxation of the compressed air can under certain circumstances cause fluid to be sprayed out of the pipette head.

It is finally proposed to mount a click-stop device which locks the cylindrical piston rod with a predetermined force in its upper end position, but releases it when this force is overcome. If the control knob is now pressed, the lower end position of the second or inner piston also then becomes easy to feel, if the compression spring tensioning the outer or first piston is not made excessively strong. The latter compression spring can thus be made weaker and thus control made easier without having to be afraid that during the delivery of the small quantities of fluid the control knob, after reaching the lower end position of the inner piston, is inadvertently depressed further in a downwards direction and thus the outer piston is also set in motion.

The present invention will now be further described by reference to the accompanying drawings in which.

Figure 1:
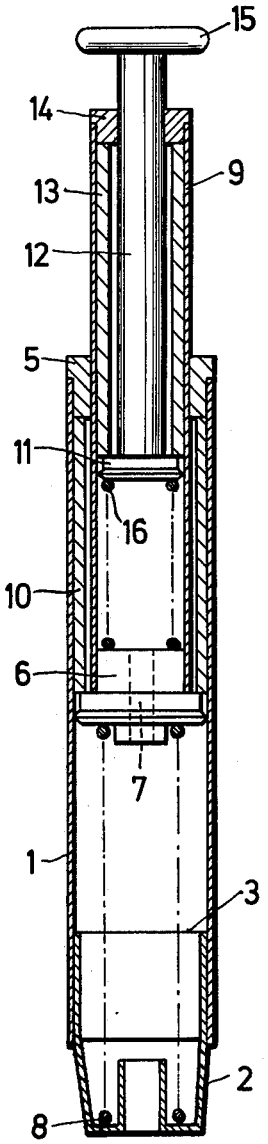
FIG. 1 shows a simplified diagrammatic representation of a section through a suction pipette without valves in accordance with the present invention.

The suction pipette shown in FIG. 1 comprises a cylinder 1 with a conical projection 2 at the lower end for the purposes of mounting an interchangeable pipette head, a piston 6 having a cylindrically shaped piston rod 9, which is displaceable in an air-tight manner between two limiting positions in the cylinder, and an inner piston 11, having a piston rod 12 and a control knob 15, which is displaceable in an air-tight manner between two limiting positions in this piston rod. The outer cylinder 1 is closed off at its upper end by a stopper 5 with a central bore through which the cylinder-shaped piston rod 9 is guided. The downwards movement of the outer piston 6, against the action of a compression spring 8, is limited by a shoulder 3, located at the spot at which the conical projection 2 is joined to the cylinder 1. On the upper side the travel of the piston 7 is limitrd by a sleeve 10, set into the cylinder. The piston 6 has a bore 7 which is continuous in an axial direction.

The inner piston 11 is subject to the effect of a compression spring 16 which is supported on its underside on the piston 6.

The lower limiting position of the piston 11 with the piston rod 12 is defined by the fact that in this limiting position the control knob 15 abuts the stopper 14 of the cylinder-shaped piston rod 9. The upper limiting position of the piston 11 is limited by the fact that it abuts the sleeve 13, set into the cylinder 9.

The suction pipette described above operates in the following manner:

After a pipette head (not shown) is mounted on the conical projection 2, the control knob 15 is firstly moved up till the stop on the stopper 14 and then it is moved downwards with the downwards movement of the piston rod 9 up to the stop of the outer piston 6 at the inner shoulder 3. Then the lower opening of the pipette head is dipped into the fluid to be sucked up and the control knob 15 released. Both compression springs 8 and 16 now move both the outer as well as the inner pistons upwards, which creates a reduced pressure in the interior of the cylinder 11 and the fluid is sucked into the pipette head. After both pistons have reached their upper limiting positions, the doses can be delivered. The control knob is thus moved downwards in each case up to the stop on the stopper 14, so that the volume of air displaced by the piston 11 effects the delivery of the metered fluid quantity. The control knob 15 is then released again and moves upwards together with the piston rod 12 and piston 11 under the effect of the spring 16. Air is thus sucked through the pipette head into the interior of the cylinder 1, until the pressure in the interior of the cylinder 1 is equal to the atmospheric exterior pressure. Renewed pressing of the control knob 15 then makes it possible to deliver a further metered quantity of fluid.

Figure 2:
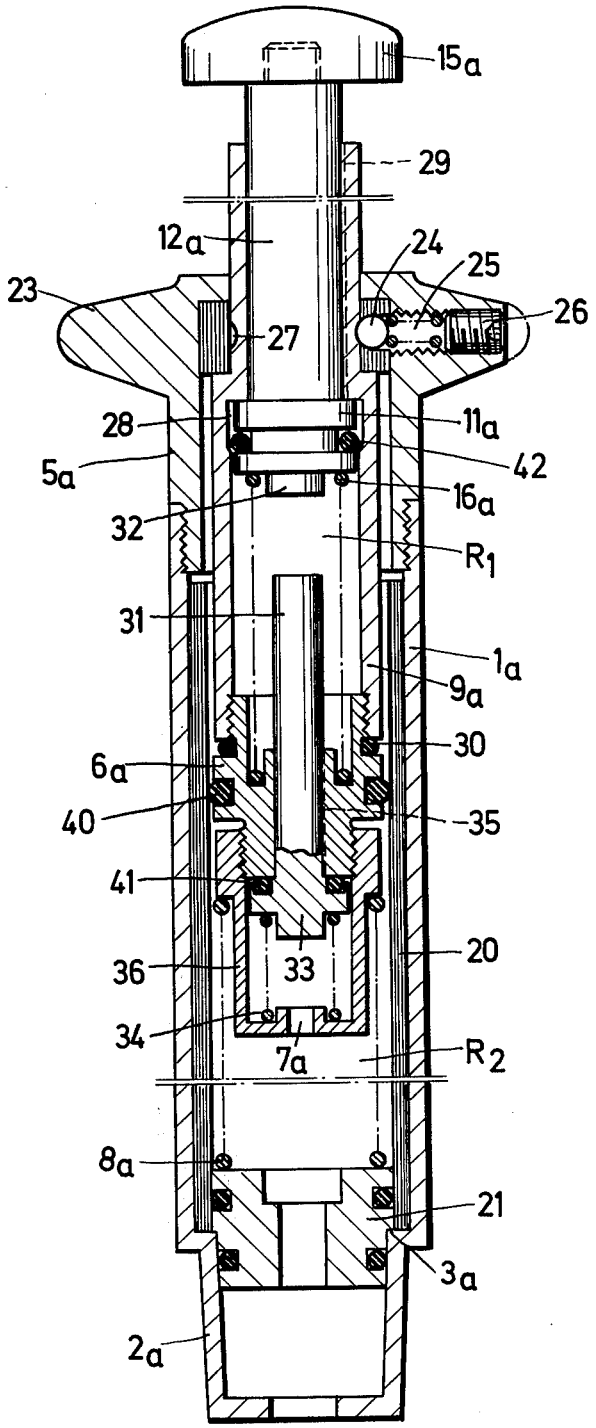
FIG. 2 shows a section through a suction pipette with controlled valves in accordance with the present invention.

The improved suction pipette shown in FIG. 2 also comprises a cylinder 1*a* with a conical projecting piece 2*a* at its lower end, a piston 6*a*, having an axial bore 7*a*, which is displaceable and guided in an air-tight manner in the cylinder, a cylinder-shaped piston rod 9*a*, connected to this piston, and a piston 11*a* which is guided in this piston rod in an air-tight manner, is displaceable and has a piston rod 12*a* and a control knob 15*a*. Here too a shoulder 3*a* is located between the cylinder 1*a* and the conical projection 2*a*, on which shoulder a cylindrical lining sleeve 20 is supported. This sleeve is connected in an air-tight manner to the cylinder 1*a* by the stopper 21 that is provided with two sealing rings. The piston 6*a* carries in a peripheral groove a sealing ring 40 of soft-elastic material, which guides the piston in an air-tight manner in the sleeve 20. The piston is provided on its upper side with a thread and with the interposition of a sealing ring 30 is screwed into a corresponding thread in the cylinder-shaped piston rod 9*a*. The piston has on its underside a projection having an external thread onto which a cap 36, belonging to the piston and having the aforementioned axial bore 7*a*, is screwed. The actual piston part 6*a* also has an axial bore which displaceably guides a plunger 31 which on its underside is connected firmly to a valve body 33 having a sealing ring 41. The valve body 33 with the plunger 31 is pressed upwards against the lower edge of the actual piston part 6*a* by a compression spring 34, accommodated in the cap 36, and thereby closes the guide bore for the plunger 31 in an air-tight manner. A longitudinal groove 35 is further located in the guide bore for the plunger 31 and allows air to enter in an axial direction when the valve 33 is lifted away. The chambers $R_1$ above the piston 6*a* and $R_2$ below the piston 6*a* and the cap 36 are thus connected to each other and an equalisation of pressure can take place.

The piston 11*a*, displaceable in the cylinder-shaped piston rod 9*a*, carries a sealing ring 42 of soft elastic material in a peripheral groove and is pressed upwards by a compression spring 16*a* which is supported on its underside on the piston 6*a*. The piston 11*a* carries on its underside a projection 32 which is intended for the stop on the plunger 31.

Chamber $R_1$ in the cylinder-shaped piston rod 9*a* is provided at its upper end, at which the piston 11*a* in FIG. 2 is located, with an extension 28. This extension allows air to pass between the sealing ring 42 and the wall of the cylindrical piston rod 9*a*, so that an equalisation of pressure between the chamber $R_1$ and external air is achieved by way of the groove 29 in the upper end of the piston rod 9*a*. As soon as the piston has moved somewhat downwards, the sealing ring 42 comes into contact with the inner wall of the cylindrical piston rod 9*a* and thus seals it.

The cylinder 1*a* is continued at its upper end by a screwed-in stopper 5*a*, having a gripping flange 23. The reduced end of the cylindrical piston rod 9*a*, located at the height of the gripping flange 23 in the position shown in FIG. 2, is provided with an outer annular groove 27, in which a ball bearing engages under the effect of a spring 25 held by the screw 26.

The suction pipette described above operates in the following manner.

After having mounted a pipette head (not shown) on the conical projection 2*a*, the control knob 15 is pressed downwards. Just before the stop of the control knob at the upper end of the piston rod 9*a*, the projection 32 on the piston 11*a* is in contact with the plunger 31 and pushes it during the last slight part travel of the piston rod 12*a* somewhat downwards so that the valve ring 41 is lifted away and an air connection exists between the chambers $R_1$ and $R_2$.

By means of further downward pressing of the control knob 15*a*, overcoming the catches 24 and 27, the cylinder-shaped piston rod 9*a* and with it the piston 6*a* are pressed downwards until the underside of the control knob abuts the front face of the gripping flange 23. The pipette head is now dipped into the fluid to be sucked up and the control knob 15*a* released. The previously compressed springs 8*a* and 16*a* press both pistons 6*a* and 11*a* upwards and cause fluid to be sucked into the pipette head.

After this movement is terminated metered part quantities can be delivered from the suction pipette in that the control knob 15*a* moves until it abuts the upper edge of the piston rod 9*a*.

At the commencement of the downwards movement of the knob 15*a* and thus of the piston rod 12*a* and the piston 11*a* the sealing ring 42*a* comes into sealing contact with tne cylinder-shaped piston rod 9*a*. From now on no more air can escape upwards from the chamber $R_1$ through the groove 29 but is compressed in the chamber $R_1$. Shortly before the end of the travel the projection 32 comes to abut the plunger 31 and thus opens the valve 33 and 41, if the latter has not already previously opened of its own accord under the effect of the excess pressure in chamber $R_1$ (this depends on the dimensions of the compression spring 34).

The air compressed in the chamber $R_1$ by the downwards movement of the piston 11*a* expands by way of the groove 35, the open valve 33 and 41, the bore 7*a*, into the chamber $R_2$ and further on until it passes into the mounted pipette head and drives out a quantity of fluid from it that is equal to the stroke volume of the piston 11*a*. The downwards movement of the piston 11*a* is limited shortly after the projection 32 comes into contact with the plunger 31 due to the control knob 15*a* abutting the cylindrical piston rod 9*a*.

After the metered quantity of fluid has run out the control knob 15*a* is released and the piston 11*a* with the piston rod 12*a* moved upwards again by the compression spring 16*a*. Shortly after this movement begins the valve 33 and 41 is already shut, so that in practice no reduced pressure is produced in the chamber $R_2$ and thus in the suction pipette by the upwards travel of the piston 11*a* and no air bubbles bubble through the fluid in the suction pipette. The projection 32 is then released from the plunger 31 and the piston moves upwards again producing a reduced pressure in the chamber $R_1$. Lastly the sealing ring 42 of the piston 11*a* moves shortly before the end position of the piston into the widened part 28 and an equalisation of pressure can now take place due to the inflow of external air through the groove 29 into the chamber $R_1$.

Figure 3:
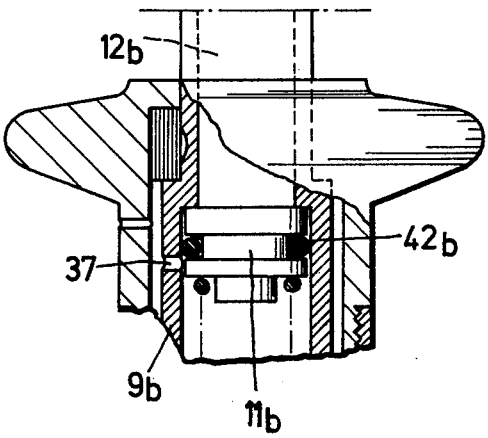
FIG. 3 shows a partial section through the upper part of the suction pipette with a different valve embodiment.

In the case of the modified embodiment shown in FIG. 3 the suction pipette described above is not provided with any extension in the cylindrical piston rod 9*b* in the upper limiting position of the piston 11*b* with the sealing ring 42*b*, but with a radially running bore 37. This bore is located just below the sealing ring 42*b* in the upper limiting position shown in FIG. 3. The bore 37 is closed during downwards movement of the piston after a quite small travel and then overtravelled so that the chamber below the piston 11*b* is then shut off from above in an air-tight manner. In this embodiment the disposition of a longitudinal groove in the end of the cylindrical piston rod 9*b* enclosing the piston rod 9*b* is no longer required.

I claim:

1. A suction pipette which comprises a cylinder having a conical projection at one end for the purpose of mounting interchangeable pipette heads, a first piston located within the cylinder and which is displaceable in an air-tight manner between two limiting positions, a first hollow, cylindrical piston rod connected, at one end, to the first piston, said first piston rod projecting out of the cylinder in all positions of the first piston and being guided within the cylinder, a first compression spring disposed within the cylinder between the first piston and the conical projection and supported at one end on a shoulder of the cylinder and at the other end on the first piston, a second piston accommodated within the first piston rod in an air-tight and displaceable manner, a second piston rod one end of which is connected to the second piston, a second compression spring biasing the second piston away from the first piston and whereby the travel of the second piston is limited by stops in such a manner that a predetermined stroke volume is achieved which is small in relation to the stroke volume of the first piston in the cylinder, a first valve means controlled by the second inner piston rod and arranged, when the second piston is in a first limiting position with the second compression spring in its least compressed form, to connect the chamber formed by the first piston rod and the second piston with the open air, the first valve means being closed when the second piston is moved away from the first limiting position, and a second valve means also controlled by the second piston and arranged, when the second piston is in a second limiting position with the second compression spring in its most compressed form to connect said chamber with the chamber formed by the cylinder and the first piston, the second valve means being closed when the second piston moves a small distance away from the second limiting position towards the first limiting position.

2. A suction pipette as claimed in claim 1, wherein the first valve means is formed by a widening of the first hollow cylindrical piston rod, which accommodates the second inner piston at or adjacent the first limiting position of the second piston.

3. A suction pipette as claimed in claim 1, wherein the first valve means is formed by a bore in the wall of the first hollow, cylindrical piston rod adjacent the second piston located in the first limiting position.

4. A suction pipette as claimed in claim 1, wherein the second valve means is a spring-loaded non-return valve, which is opened by a projection on the second piston when the said second piston, during its movement from the first limiting position to the second limiting position, is located just above the second limiting position.

5. A suction pipette as claimed in claim 1 wherein the second valve means is a spring-loaded non-return valve and the spring thereof is of such a strength that it is opened by the excess pressure produced by the movement of the second piston from the first limiting position to the second limiting position.

6. A suction pipette as claimed in claim 5 wherein the second valve means is a spring-loaded non-return valve and the spring thereof is of such a strength that it is opened by the excess pressure produced by the movement of the second piston from the first limiting position to the second limiting position.

7. A suction pipette as claimed in claim 1, further comprising a click-stop device which locks the first hollow, cylindrical piston rod, with a predetermined force, in a first limiting position wherein the first compression spring is in its least compressed form and releases the first piston rod when this force is overcome.

* * * * *